US006037848A

United States Patent [19]

Alila et al.

[11] Patent Number: 6,037,848

[45] Date of Patent: Mar. 14, 2000

[54] ELECTRICALLY REGULATED FILTER HAVING A SELECTABLE STOP BAND

[75] Inventors: Mauri Alila; Tapio Rättilä , both of Kempele, Finland

[73] Assignee: LK-Products OY, Kempele, Finland

[21] Appl. No.: 08/937,852

[22] Filed: Aug. 25, 1997

[30] Foreign Application Priority Data

Sep. 26, 1996 [FI] Finland ..... 963841

[51] Int. Cl.[7] ..... H01P 1/201

[52] U.S. Cl. ..... 333/202; 333/207; 333/235

[58] Field of Search ..... 333/202, 205, 333/207, 174, 235, 103, 104, 126, 134

[56] References Cited

U.S. PATENT DOCUMENTS 5,065,120 11/1991 Munn ..... 333/202 X
5,515,017 5/1996 Yamada et al. ..... 333/207
5,519,364 5/1996 Kato et al. ..... 333/103
5,541,560 7/1996 Turunen et al. ..... 333/207

FOREIGN PATENT DOCUMENTS 94298 4/1994 Finland .
WO 95/04383 2/1995 WIPO .

*Primary Examiner*—Seungsook Ham
*Attorney, Agent, or Firm*—Darby & Darby

[57] ABSTRACT

A band-rejection filter (1) comprising transmission line resonators (2, 3) further comprises switching means (7, 8) to provide an electrical connection between each transmission line resonator and a certain fixed potential in response to a certain control signal. The fixed potential is advantageously the ground potential, whereby the control signal causes the resonators to be shunted and the frequency response of the filter to be changed into a low-pass-type frequency response.

13 Claims, 7 Drawing Sheets

ELECTRICALLY REGULATED FILTER HAVING A SELECTABLE STOP BAND

FIELD OF THE INVENTION

The invention relates in general to filters based on transmission line resonators and in particular to a filter arrangement wherein the frequency response can be changed by means of an electric control signal.

BACKGROUND OF THE INVENTION

Filters based on transmission line resonators are fundamental components in modem radio apparatuses. Categorized according to the frequency response, the commonest filter types are band-rejection and band-pass filters which are used to attenuate high-frequency signals on a desired frequency band (band-rejection) or outside a certain frequency band (band-pass). In addition, low-pass and high-pass filters are used. Transmission line resonators, the resonating frequencies of which determine a filter's frequency response, are usually cylindrical coil conductors, or helixes, plated grooves or holes formed in a dielectric medium, coaxial outer/inner conductor pairs or striplines formed on a board-like substrate. There are usually from two to about eight resonators in a filter. A filter is connected to the rest of the radio apparatus via input, output and control signal ports.

In many applications it is advantageous if the filter's frequency response can be altered during the operation by means of sending an electric signal to the filter. For example, in many cellular mobile phones the transmission and reception occur on a fairly narrow frequency band which may be located at various parts of a wider frequency range. Then the receiver band-pass filter, the task of which is to prevent signals other than the desired signal from entering the receiver, has to be adjusted so that the attenuation minimum in its frequency response coincides with the frequency of the desired signal. There also exist in the prior art duplex filters in telephones based on frequency duplexing, wherein the receive branch pass band is wide when the apparatus is not transmitting and narrow when the apparatus is transmitting and the powerful transmitted signal must be prevented from entering the sensitive reception parts. Naturally, it must also be possible to shift the narrow reception pass band to that particular location of the reception frequency range where the desired signal is located.

In the prior art there does not exist a simple filter that could be changed by means of an electric signal from a band-rejection filter into a low-pass filter in such a manner that the filter as a low-pass filter passes the whole previous stop band but in both cases attenuates the harmonics of the band in question. A functionally equivalent arrangement according to the prior art requires two separate filters in the radio apparatus, one of which is a band-rejection filter and the other a low-pass filter. A separate switch arrangement selects one filter at a time for use. Disadvantages of this kind of an arrangement include the need for space for separate filters and the attenuation of the high-frequency signal as it propagates through the switch arrangement.

An object of the invention is to provide a radio-frequency filter which can be converted from a band-rejection filter to a low-pass filter by means of an electric signal. Another object of the invention is that the arrangement according to the invention is easily applied to filters based on various types of resonators. Yet another object of the invention is that the convertible filter according to the invention is small in size and produces only a little amount of unwanted attenuation. A further object of the invention is that the filter according to the invention can be realized using a relatively small quantity of components.

SUMMARY OF THE INVENTION

The objects of the invention are achieved by a filter arrangement wherein transmission line resonators connected as a band-rejection filter also include a circuit which as a response to a certain control signal fixes a certain part of each transmission line resonator to a desired constant potential.

The filter arrangement according to the invention is characterized in that it comprises a control signal port for an external control signal and a first switch coupled to a first transmission line resonator and a second switch coupled to a second transmission line resonator in the filter, wherein the switches are arranged so as to provide an electrical connection between the transmission line resonators coupled to them and a certain fixed potential as a response to a certain control signal in order to change the frequency response of the filter into a low-pass type frequency response.

The invention is based on the realization that a transmission line resonator in a band-rejection filter can be shunted by coupling some point of the resonator to a constant potential which is preferably a ground potential. A shunted resonator in the circuit does not cause significant attenuation on a signal the frequency of which is on the stop band of the non-shunted resonator coupling. However, the arrangement attenuates the harmonics of the frequency band in question almost regardless of whether the resonators are shunted or not.

The implementation of the invention depends to a certain degree on the technology used to realize the resonators. The circuit that responds to a control signal by coupling a certain point of the resonators to a constant potential is connected to the resonators in a known manner. In the case of helix resonators, the coupling is preferably realized in the form of tapping, which refers to a conductor soldered to a certain point in a helix-shaped cylindrical coil conductor. Coupling methods applicable to other resonator structures are described later on. The switch in the regulating circuit according to the invention is a known electrically controlled switch, such as a PIN diode or a transistor.

The invention is described in greater detail with reference to the advantageous embodiments presented by way of example and to the attached drawing, wherein

BRIEF DESCRIPTION OF THE DRAWINGS

Like elements in the drawing are denoted by like reference designators.

DETAILED DESCRIPTION OF THE PREFERRED EMBODIMENTS

Figure 1:
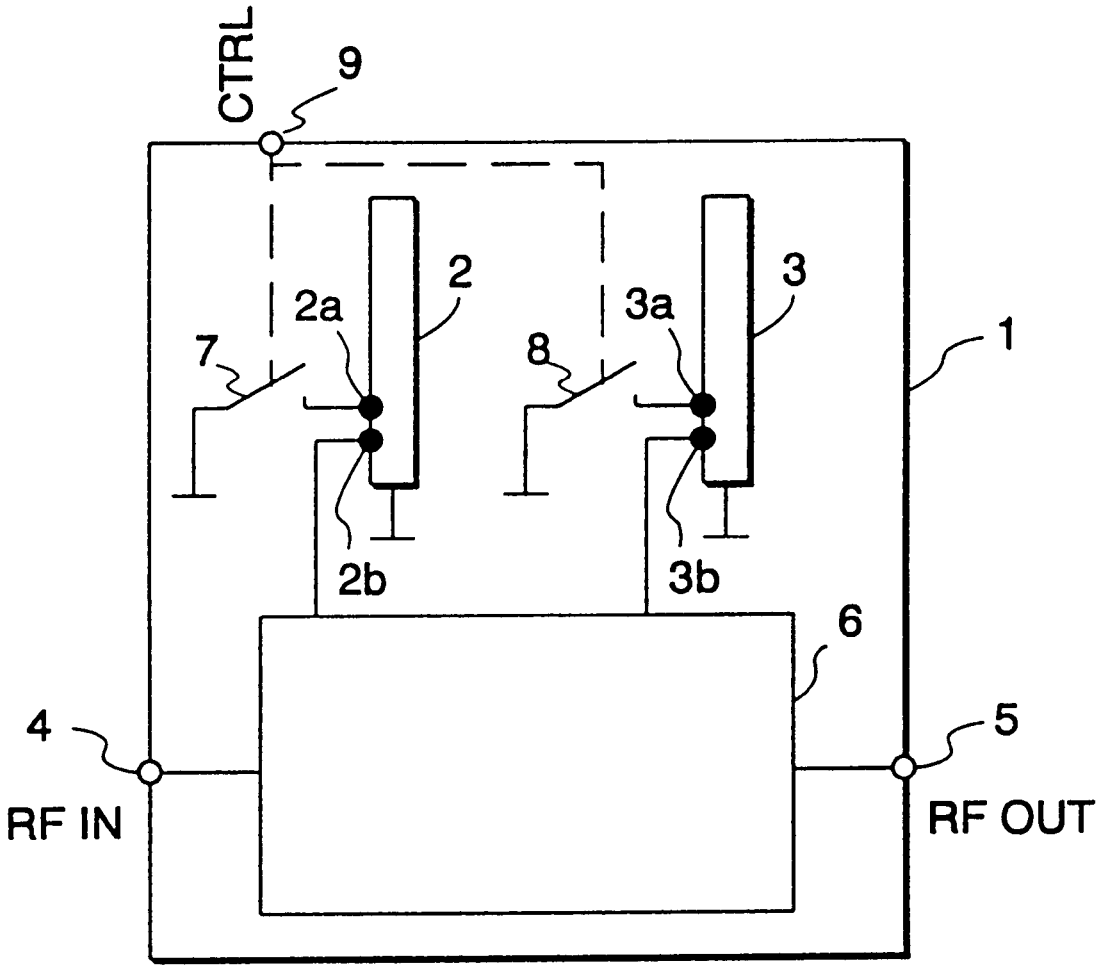
FIG. 1 shows schematically the principle of the invention.

FIG. 1 shows a filter 1 comprising two transmission line resonators 2 and 3. The invention does not limit the circuit number of the filter, ie. the number of resonators in it, but this patent application describes in particular two-resonator filters, because the objective is to build a small filter and, normally, two is the minimum number of resonators. The filter shown has an input port 4 and an output port 5. Block 6 includes matching and other circuits which are used to adjust the input and output impedances of the filter to correspond to desired values and which together with the resonators 2 and 3 produce a band-rejection-type frequency response when the frequency response is not influenced in any other way. A person skilled in the art is familiar with the procedures of drawing up and specifying the circuits represented by block 6.

According to the invention the filter 1 also includes switches 7 and 8, both of which are connected between one transmission line resonator and the ground potential. The operation of the switches is controlled by a signal brought to a control signal port 9. In the embodiment shown, the switches have two positions and they operate in phase, ie. a certain first value of the control signal drives both switches open and a certain second value of the control signal drives both switches closed. When closed, the switches significantly change the electrical characteristics of resonators 2 and 3 because the grounded point 2*a*, 3*a* is located in both resonators quite close to point 2*b*, 3*b* at which the resonator is coupled to block 6 to realize the band-rejection function.

Figure 2:
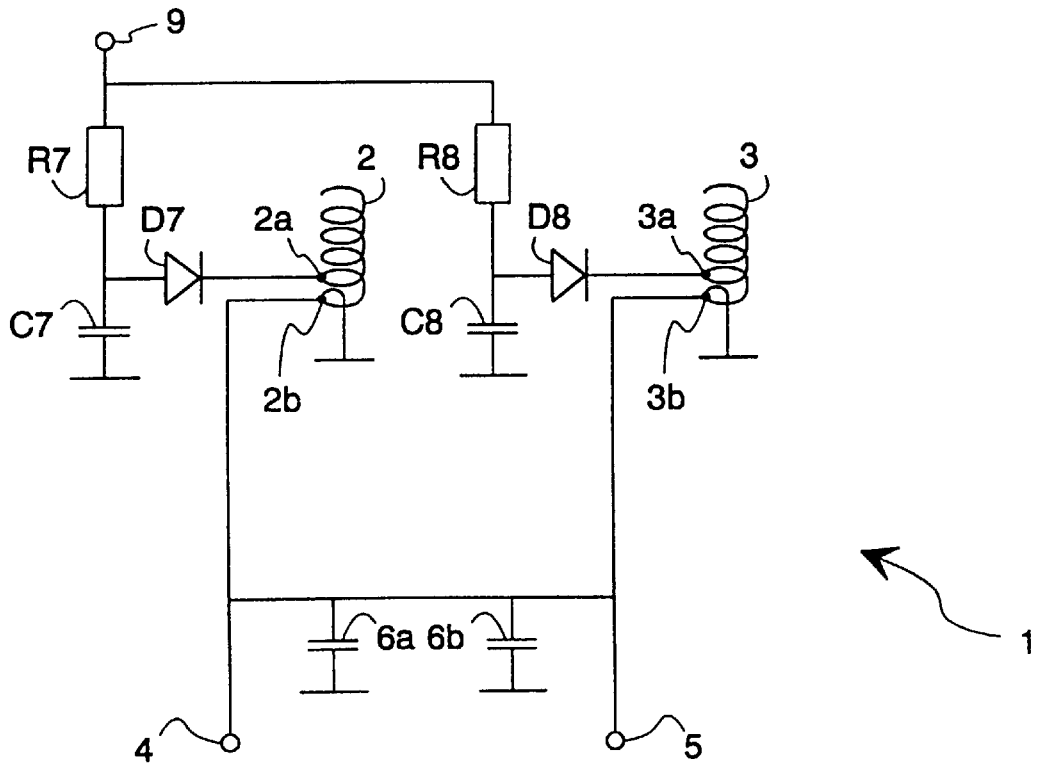
FIG. 2 shows a circuit diagram of the application of the invention to a filter comprising helix resonators.

FIG. 2 shows a circuit diagram of a filter 1 comprising two helix resonators 2 and 3. There is a galvanic connection between an input port 4 and the first helix resonator 2 via a tapping point 2*b*. Similarly, there is a galvanic connection between an output port 5 and the second helix resonator 3 via a tapping point 3*b*. Capacitances 6*a* and 6*b* and the transmission lines that provide the connections between the input and output ports 4, 5 and the resonators 2, 3 correspond to block 6 of FIG. 1.

According to the invention, the filter shown in FIG. 2 includes a switch circuit comprising two PIN diodes D7 and D8, capacitances C7 and C8 and resistances R7 and R8. The cathodes of the both PIN diodes are connected each to a helix resonator at a special additional tapping point 2*a* and 3*a*. Capacitance C7 is connected between the anode of PIN diode D7 and the ground potential, and capacitance C8 is connected between the anode of PIN diode D8 and the ground potential. In addition, there is a connection from the anodes of both PIN diodes via resistance R7, R8 to the control signal port 9. In the embodiment shown, the distance between the tapping point 2*b*, 3*b* and the additional tapping point 2*a*, 3*a* corresponds to about one helix turn in both helix resonators. However, the distance may also be shorter or longer than one helix turn.

Figure 3A:
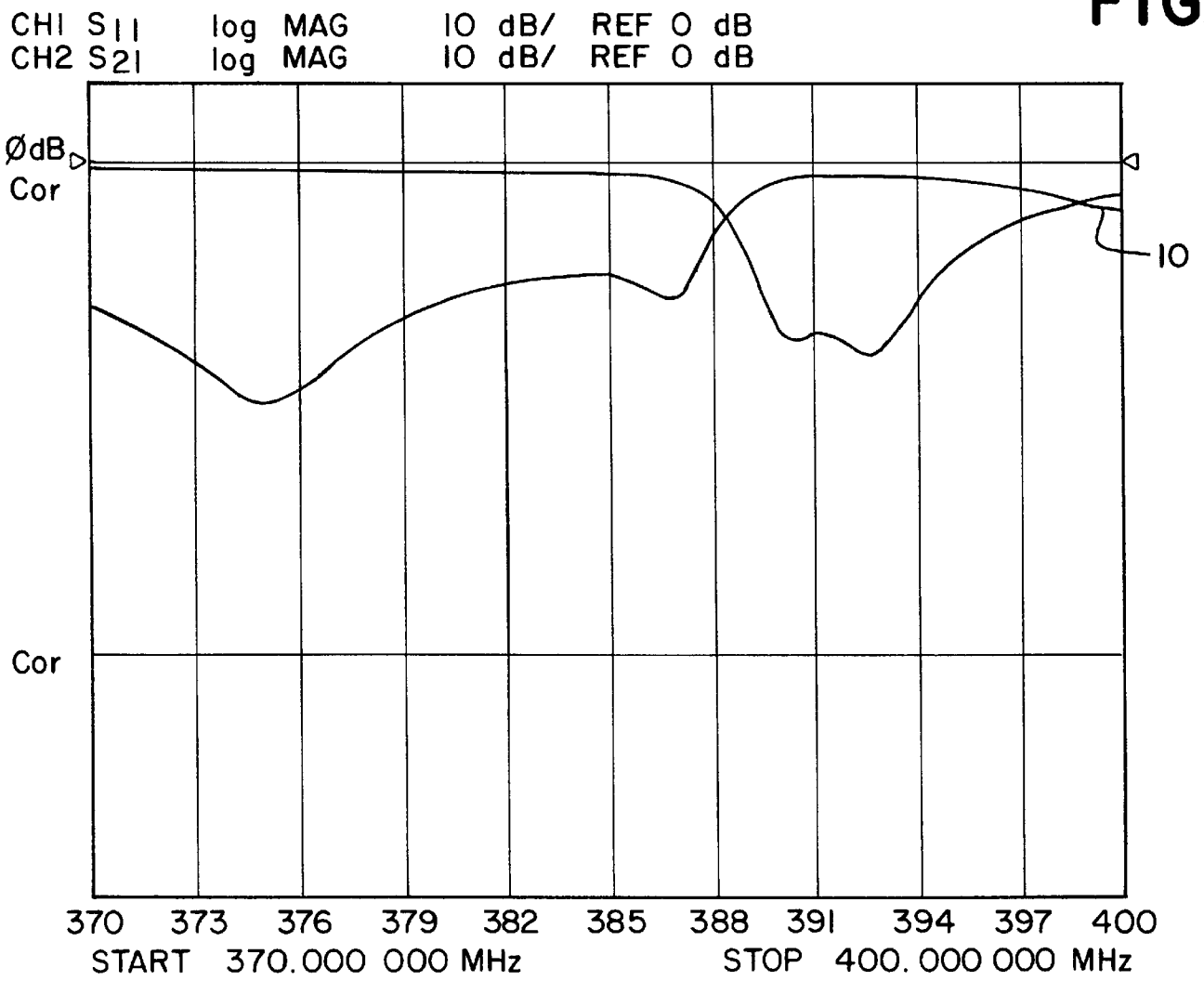
FIGS. 3*a*–3*d* show the measured frequency responses of the filter according to FIG. 2 in different cases.
Figure 3B:
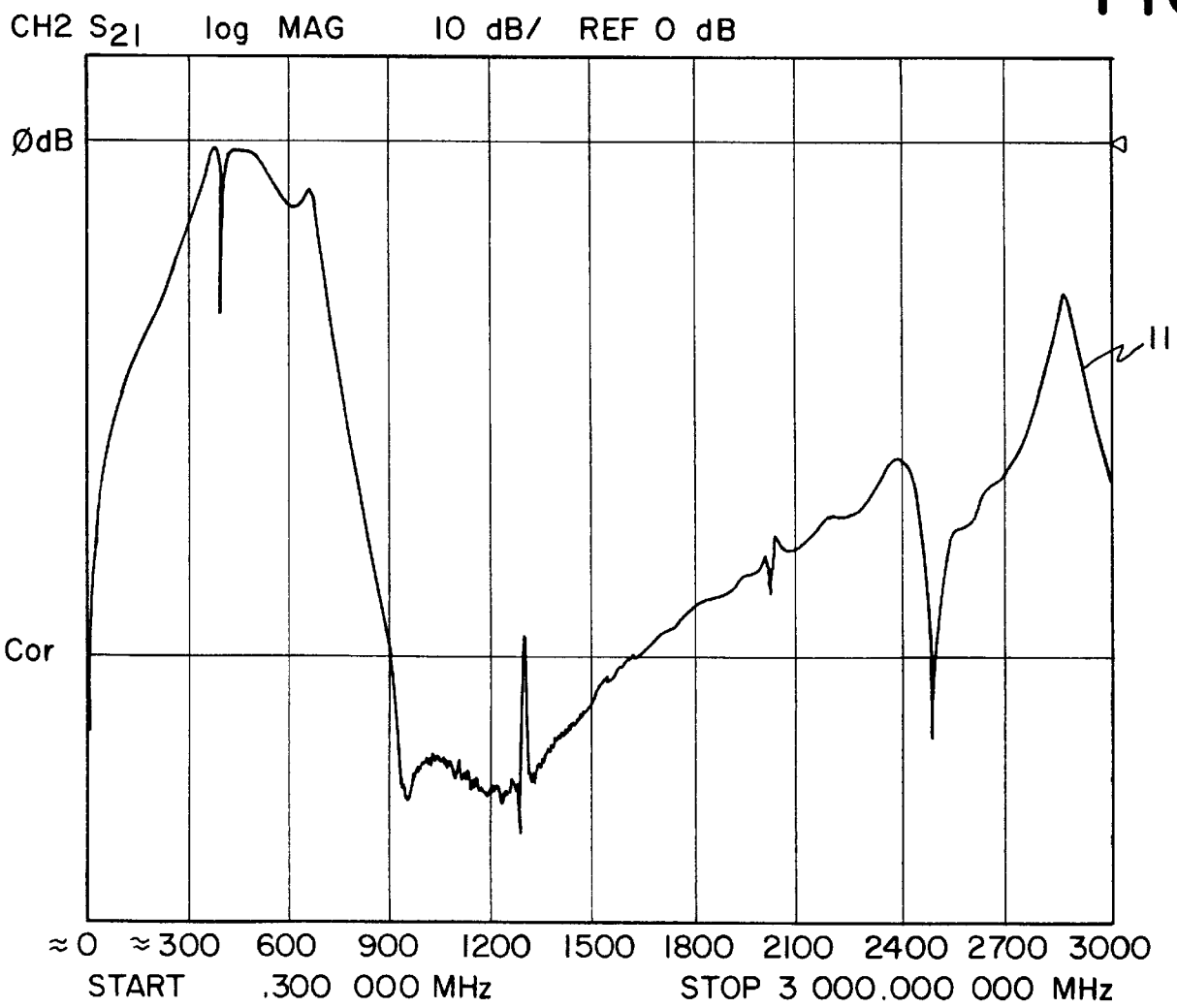

In connection with the research work that led to the invention it was manufactured a helix resonator-based filter according to FIG. 2 and its frequency response was measured with different values of a voltage signal brought to the control signal port 9. When the control signal is zero, or the control signal port 9 is substantially at ground potential, PIN diodes D7 and D8 are reverse-biased, which corresponds to the open position of switches 7 and 8 in FIG. 1. Then the frequency response of the filter, described as a pass from the input port 4 to the output port 5, is in accordance with FIGS. 3*a* and 3*b*. In FIG. 3*a*, curve 10 depicts the transmission coefficient on a decibel scale as the frequency changes from 370 MHz to 400 MHz. The curve shows, in the form of a drop in the curve, a stop band the center frequency of which is about 392 MHz. FIG. 3*b* illustrates by means of curve 11 measurement of the transmission coefficient at higher frequencies. FIG. 3*b* shows that at the first harmonic (784 MHz) of the stop band center frequency the attenuation is over −30 dB and at the other harmonics up to 2 GHz, the attenuation is over −50 dB.

Figure 3C:
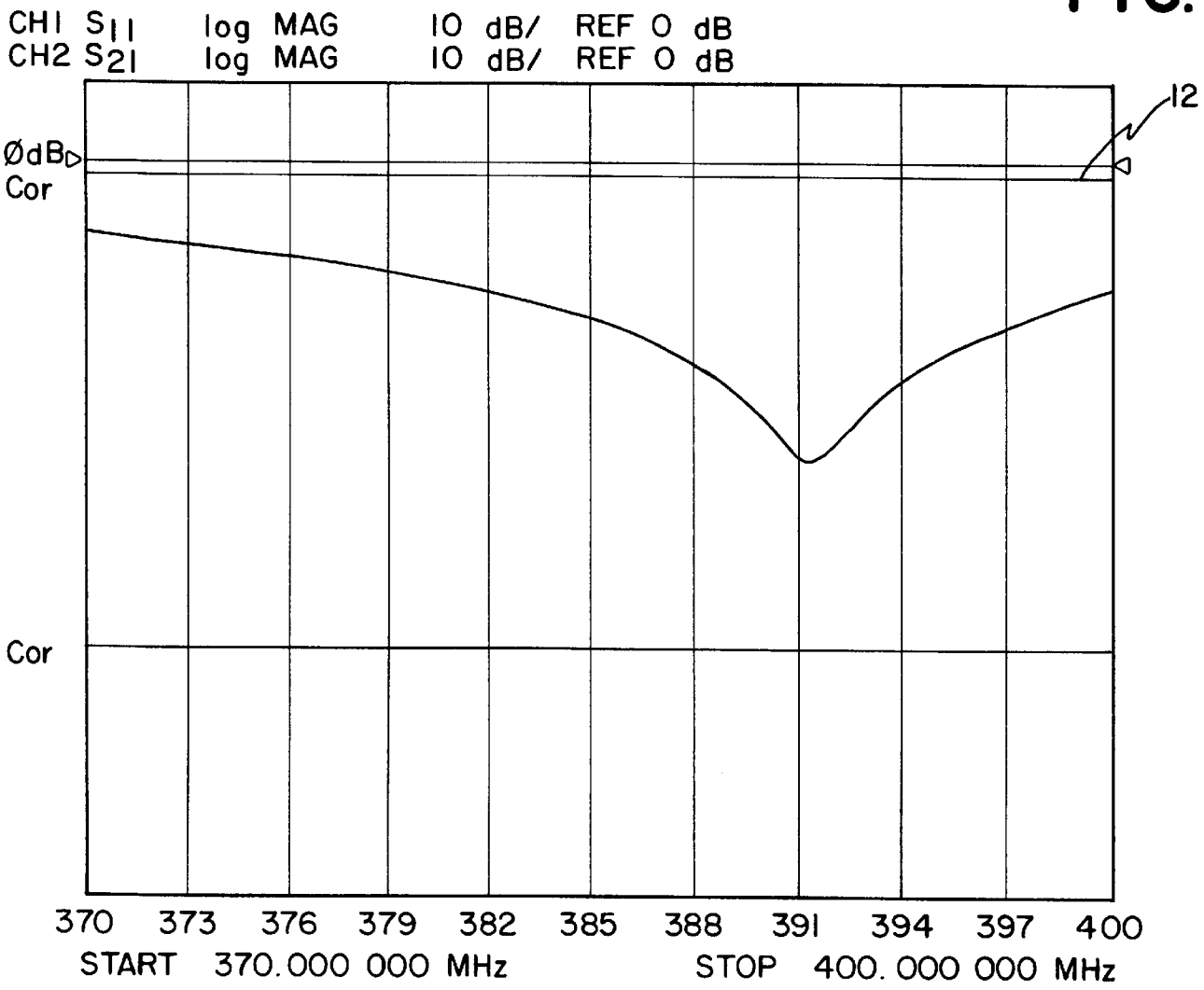
Figure 3D:
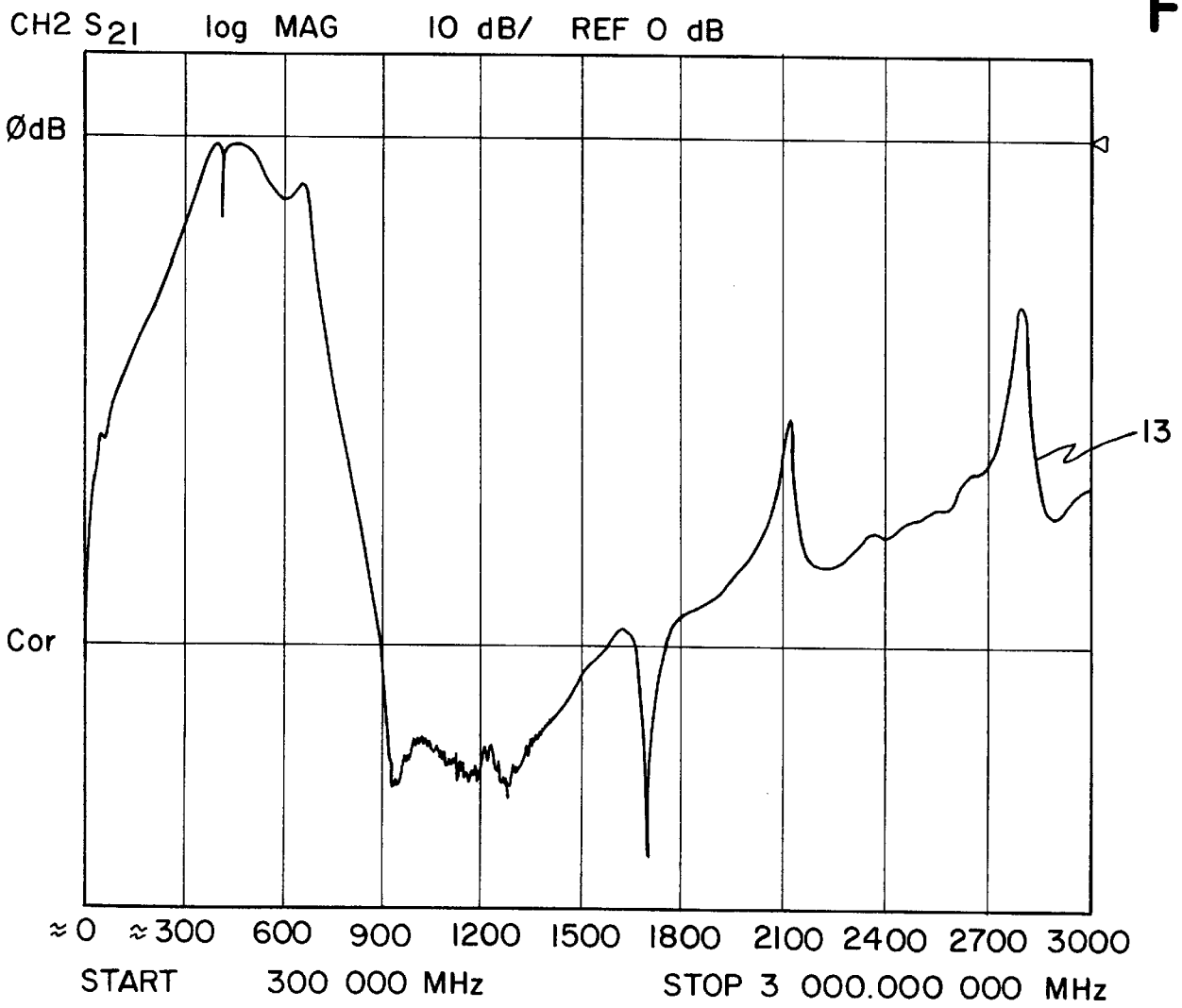

When a positive voltage signal is brought to the control signal port 9 in a filter according to FIG. 2, PIN diodes D7 and D8 become forward-biased. Then, as far as a radio-frequency signal is concerned, there is a connection from the additional tapping points 2*a* and 3*a* to the ground potential. Capacitances C7 and C8 isolate the d.c. voltage signal brought to the control signal port from the ground potential, and resistances R7 and R8 prevent the radio-frequency signal from being connected to the control signal port 9. FIGS. 3*c* and 3*d* depict the pass of the filter at the fundamental frequency (FIG. 3*c*, curve 12) and at the harmonics (FIG. 3*d*, curve 13) when a positive voltage signal is brought to the control signal port. Curve 12 shows that the pass of the filter is almost flat and less than −1 dB throughout the measured range. Curve 13 in FIG. 3*d* however shows that the attenuation of the harmonic frequencies is almost identical to FIG. 3*b*, where there is no voltage signal at the control signal port.

Figure 4:
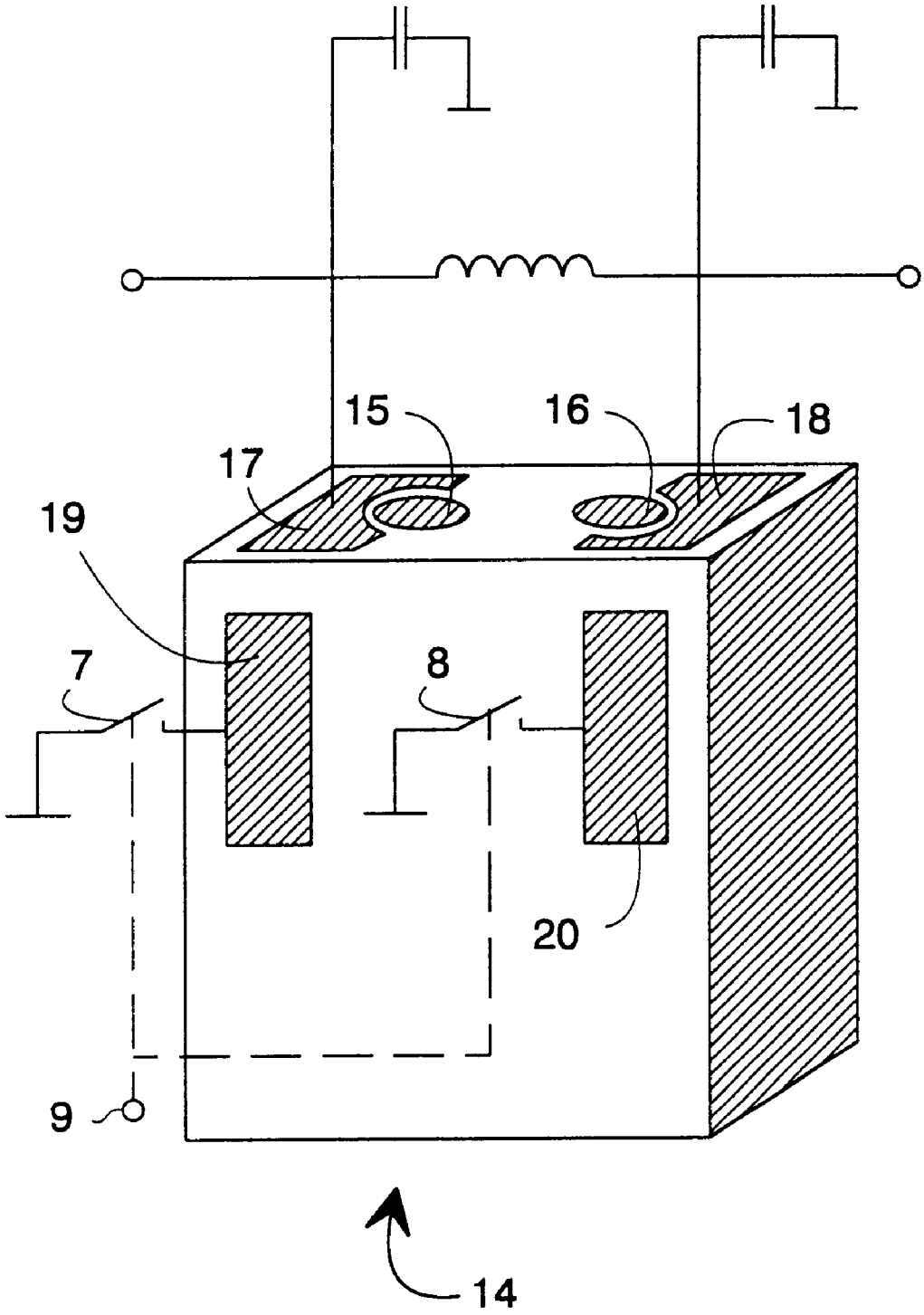
FIG. 4 shows the application of the invention to a dielectric filter.

The invention is not limited to helix resonator implementations. FIG. 4 shows a dielectric block 14 which is substantially a rectangular prism bounded by four side surfaces parallel in pairs, the adjacent side surfaces being perpendicular to each other, and by two end surfaces perpendicular to the side surfaces. Two cylindrical holes 15 and 16 extend from one end surface to the other and the inner surfaces of the holes are coated with an electrically conductive material (shadowed in the drawing), both holes thus forming together with the partial coating of the block's outer surface a transmission line resonator. Building a filter using a dielectric resonator block according to FIG. 4 is prior art technology. Block 14 need not be one continuous piece but it may comprise several parts attached together. For example, each resonator may be formed in a body block part of its own. Furthermore, the block need not be shaped as a rectangular prism.

For coupling to the resonators, the upper end surface shown in the drawing, which is otherwise uncoated, has coupling areas 17 and 18 formed of a conductive coating. According to the invention, it is also formed on a side surface of the dielectric block coupling areas 19 and 20 to which a switch circuit can be coupled to ground the coupling areas 19 and 20 in response to a certain control signal. A capacitive coupling from transmission line resonators 15 and 16 via coupling areas 19 and 20 to the ground potential causes the frequency response of the filter in connection of which the resonators are used, to change in the manner described above, referring to FIGS. 3*a* to 3*d*. The switch circuit comprising switches 7 and 8 and a control signal port 9 is shown only schematically, but its implementation using, say, separate components attached to soldering pads (not shown) formed on the surface of the block is as such prior art technology.

It is known to construct capacitive and/or galvanic couplings also in other types of resonators, such as stripline and coaxial resonators, so the ground coupling according to the invention can be easily applied to them. The location of the grounding point in the resonator and the ratings of the components used in the ground coupling can be determined by experimenting as they are influenced by the desired impedance matching of the filter and the desired overall attenuation of the signal, for example.

Above it was presented measurement results for a filter having a nominal operating frequency of about 417 MHz, but the invention is not limited to filters of any particular frequency range. It can most advantageously be applied to all apparatuses processing a radio-frequency signal wherein the filters have to be small in size and their frequency response must be electrically alterable. The invention includes few other components apart from the resonators, so its manufacturing costs are low and it is well suited to mass production. Due to the small number of components, the invention produces very little unwanted attenuation in a radio-frequency signal.

We claim:

1. A radio-frequency filter having a stop band around a center frequency and comprising:

an input port and an output port;

a first transmission line resonator and a second transmission line resonator electrically coupled to said input and output ports;

a control signal port for receiving a control signal;

a first switch directly connected to a mid-portion of said first transmission line resonator and to a first fixed potential;

a second switch directly connected to a mid-portion of said second transmission line resonator and to a second fixed potential;

said first and second switches being responsive to said control signal to electrically connect said first and second transmission line resonators with said first and second fixed potential, respectively, to change said center frequency.

2. The radio-frequency filter of claim 1, wherein said first and second fixed potentials are a ground potential.

3. The radio-frequency filter of claim 1, wherein said first and second transmission line resonators are helix resonators.

4. A radio-frequency filter having a stop band around a center frequency and comprising:

an input port and an output port;

a first transmission line resonator and a second transmission line resonator electrically coupled to said input and output ports;

a control signal port for receiving a control signal;

a first switch connected between said first transmission line resonator and a first fixed potential;

a second switch connected between said second transmission line resonator and a second fixed potential;

said first and second switches being responsive to said control signal to electrically connect said first and second transmission line resonators with said first and second fixed potential, respectively, to change said center frequency; wherein said first transmission line resonator is coupled to said input and output ports through a first tapping point and is directly coupled to said first switch through a first additional tapping point; and said second transmission line resonator is coupled to said input and output ports through a second tapping point and is directly coupled to said second switch through a second additional tapping point.

5. A radio-frequency filter having a stop band around a center frequency and comprising:

an input port and an output port;

a first transmission line resonator and a second transmission line resonator electrically coupled to said input and said output ports;

a control signal port for receiving a control signal;

a first switch connected between said first transmission line resonator and a first fixed potential;

a second switch connected between said second transmission line resonator and a second fixed potential;

said first and second switches being responsive to said control signal to electrically connect said first and second transmission line resonators with said first and second fixed potentials, respectively, to change said center frequency;

said first transmission line resonator is coupled to said input and output ports through a first tapping point and is coupled to said first switch through a first additional tapping point;

said second transmission line resonator is coupled to said input and output ports through a second tapping point and is coupled to said second switch through a second additional tapping point; and wherein said first and second transmission line resonators are helix resonators and the distance from the first and second tapping point to the respective first and second additional tapping point substantially corresponds to one helix turn of said respective first and second transmission line resonator.

6. The radio-frequency filter of claim 1, wherein said first and second transmission line resonators are dielectric resonators.

7. The radio-frequency filter of claim 1, wherein said first and second transmission line resonators are coaxial resonators.

8. The radio-frequency filter of claim 1, wherein said first and second transmission line resonators are stripline resonators.

9. A radio-frequency filter having a stop band around a center frequency and comprising:

an input port and an output port;

a first transmission line resonator and a second transmission line resonator electrically coupled to said input and output ports;

a control signal port for receiving a control signal;

a first switch directly connected to a mid-portion of said first transmission line resonator and to a first fixed potential;

a second switch directly connected to a mid-portion of said second transmission line resonator and to a second fixed potential;

said first and second switches being responsive to said control signal to electrically connect said first and second transmission line resonators with said first and second fixed potential, respectively, to change said center frequency;

said first and second switches each comprising a PIN diode having a cathode coupled to said respective first or second transmission line resonator and an anode coupled via a capacitive element to said respective first or second fixed potential, and further comprising a resistive element coupled between the anode of said PIN diode and said control signal port.

10. A radio-frequency filter having a stop band around a center frequency and comprising:

an input port and an output port;

a first transmission line resonator and a second transmission line resonator electrically coupled to said input and output ports;

a control signal port for receiving a control signal;

a first capacitive coupling area associated with a mid-portion of the first transmission line resonator;

a second capacitive coupling area associated with a mid-portion of the second transmission line resonator, the second capacitive coupling area being separate from the first capacitive coupling area;

a first switch connected between the first capacitive coupling area and a first fixed potential;

a second switch connected between the second capacitive coupling area, and a second fixed potential;

said first and second switches being responsive to said control signal to electrically connect said first and second transmission line resonators with said first and second fixed potential via the first and second capacitive coupling areas, respectively, to change said center frequency.

11. The radio-frequency filter of claim 10, wherein said first and second transmission line resonators are dielectric resonators.

12. The radio-frequency filter of claim 10, wherein said first and second transmission line resonators are coaxial resonators.

13. The radio-frequency filter of claim 10, wherein said first and second transmission line resonators are stripline resonators.

* * * * *

UNITED STATES PATENT AND TRADEMARK OFFICE

CERTIFICATE OF CORRECTION

PATENT NO. : 6,037,848

DATED : March 14, 2000

INVENTOR(S) : Mauri ALILA and Tapio RATTILA

It is certified that errors appear in the above-identified patent and that said Letters Patent is hereby corrected as shown below:

Foremost page, [22], Filing Date, change "Aug. 25, 1997" to --Sep. 25, 1997--.

Signed and Sealed this

Eighth Day of May, 2001

*Attest:*

Nicholas P. Godici

NICHOLAS P. GODICI

*Attesting Officer*

*Acting Director of the United States Patent and Trademark Office*